US006109975A

United States Patent [19]

Nitta

[11] Patent Number: 6,109,975

[45] Date of Patent: Aug. 29, 2000

[54] ELECTRIC CONNECTOR

[75] Inventor: Kazuto Nitta, Shizuoka, Japan

[73] Assignee: Koito Manufacturing Co., Ltd., Tokyo, Japan

[21] Appl. No.: 09/035,147

[22] Filed: Mar. 5, 1998

[30] Foreign Application Priority Data

Mar. 5, 1997 [JP] Japan ..... 9-049974

[51] Int. Cl.[7] ..... H01R 13/502

[52] U.S. Cl. ..... 439/686; 439/596

[58] Field of Search ..... 439/686, 586, 439/752.5, 596, 599, 603, 701, 695, 712, 718, 724, 713

[56] References Cited

U.S. PATENT DOCUMENTS

| | | | |
|---|---|---|---|
| 4,348,070 | 9/1982 | Simon | 439/586 |
| 4,461,528 | 7/1984 | Durand et al. | 339/98 |
| 5,173,062 | 12/1992 | Uchida | 439/617 |
| 5,295,857 | 3/1994 | Toly | 439/395 |
| 5,344,347 | 9/1994 | Inoue et al. | 439/701 |
| 5,562,339 | 10/1996 | Tanaka et al. | 362/61 |
| 5,664,967 | 9/1997 | Hatagishi et al. | 439/596 |
| 5,664,969 | 9/1997 | Peterson et al. | 439/746 |
| 5,676,564 | 10/1997 | Kobayashi et al. | 439/509 |

FOREIGN PATENT DOCUMENTS

| | | | |
|---|---|---|---|
| 0 187 255 | 11/1985 | European Pat. Off. | H01R 13/436 |
| WO 96/36092 | 11/1996 | WIPO | H01R 13/422 |

*Primary Examiner*—Paula Bradley
*Assistant Examiner*—Ross Gushi
*Attorney, Agent, or Firm*—Sughrue, Mion, Zinn, Macpeak & Seas, PLLC

[57] ABSTRACT

An electric connector comprises: electric terminals; and a connector housing formed from an insulating member. The connector housing comprises, a body portion having a pipe-like shape with base-end opening portions to which the electric terminals are inserted, a cover portion for covering the base-end opening portions of the body portion, and hinge portions connecting the body portion with the cover portion and being deformable to bend to make the cover portion cover the body portion.

5 Claims, 6 Drawing Sheets

ELECTRIC CONNECTOR

BACKGROUND OF INVENTION

The present invention relates to an electric connector for making electric connection for a lamp of a vehicle or the like, and particularly relates to an electric connector having a simple configuration in which a connector housing is molded with resin.

In a lamp of a vehicle, an electric connector is used for electrically connecting a harness (power supply wiring) which is connected to an on-vehicle battery to a bulb or a bulb socket of the lamp. One such electric connector, for example, has electric terminals made by bending metal pieces and inserting them into a molded resin connector housing. FIG. 6 shows an example of such an electric connector. In FIG. 6, a connector housing 5 has a configuration, formed by resin molding, in which two rectangular pipe-like portions 51 are arranged in parallel and integrally with each other through a connection body 52. Two electric terminals 3 are inserted into rectangular pipe-like portions 51 through opening portions of the respective rectangular pipe-like portions 51, and fixed in the respective rectangular pipe-like portions 51. Conventionally, such electric terminals 3 have been used widely. In each of the electric terminals 3, opposite side portions 32 of a conductive metal member 31 are formed into J-shape by bending the end portions toward the inner surface. A bulb base terminal or socket base terminal of a lamp is inserted between these J-shaped opposite side portions 32 and the inner surface of each metal member 31 to thereby make electric connection with the base terminal. In addition, an end portion of a coated wire 34 is clamped at one end portion 33 of the metal member 31 to thereby make electric connection with the coated wire.

As the technique to fix the above-mentioned electric terminals 3 into the connector housing 5, there is a proposal in which a bonding agent is charged into openings of the respective rectangular pipe-like portions 51 of the connector housing 5 so as to fix the electric terminals 3 by solidification of the bonding agent. There is another proposal in which special electric terminals having not-shown projecting members formed on one-side portions of the metal members 31 integrally therewith are manufactured, and when the electric terminals 3 are inserted into the rectangular pipe-like portions 51 respectively, the projecting members are fitted into not-shown recess portions provided in the rectangular pipe-like portions so as to prevent the electric terminals 3 from being detached. If electric terminals are fixedly supported in a connector housing in such a manner as mentioned above and the connector housing is attached/detached to/from the bulb base terminals, the attachment/detachment between two electric terminals and bulb base terminals of a lamp can be performed simultaneously. Accordingly, it is possible to perform electric wiring of the lamp easily.

In such conventional techniques, the former one for fixing electric terminals to a connector housing with a bonding agent has a problem that it is difficult to exchange the electric terminals when the electric terminals are broken after bonding the electric terminals with a bonding agent. In the latter one for fixing the electric terminals with projecting members, on the other hand, it is necessary to prepare special electric terminals. Accordingly, there is a problem that the cost increases. In addition, it is necessary to form recess portions in a connector housing so that the projecting members are fitted into the recess portions. Accordingly, there is a problem that a mold for forming the connector housing is so complicated that it is difficult to manufacture the mold. Further, in either of the above-mentioned techniques, the electric terminals fixed in the connector housing are exposed from the connector housing. Accordingly, an accident of short-circuit is apt to occur between the electric terminals. In addition, when a high voltage is applied to the electric terminals, there arises a problem in safety such that an accident of electric shock or the like is generated. In addition, in either technique, two electric terminals are fixed in the connector housing firmly. Accordingly, in case there is a position error in fixing positions of the electric terminals, there is a problem that the electric terminals cannot be fitted to a pair of bulb base terminals which are provided with fixed predetermined size.

SUMMARY OF INVENTION

It is an object of the present invention to provide an electric connector in which electric terminals can be fixed and replaced easily, which is superior in safety, and which can make electric connection surely.

According to the present invention, provided is an electric connector comprising a connector housing formed from an insulating member, and conductive electric terminals inserted into the connector housing, wherein the connector housing includes a pipe-like body portion having base-end opening portions to which the electric terminals are inserted, a cover portion for covering the base-end opening portions of the body portion, and hinge portions connecting the body portion to the cover portion and being transformable to bend to thereby make the cover portion cover the body portion. Further, means for locking the body portion and the cover portion with each other are provided on at least one of the body portion and the cover portion, so that a state of covering the body portion with the cover portion is kept by the lock means. Here, preferably, the lock means are provided at opposite side portions and center portions on each of the body portion and the cover portion. In this case, preferably, the lock means provided at the center portions of the body portion and the cover portion is constituted by a lock lance which is provided at one of the center portions and an insertion slot which is provided at the other so that the lock lance is inserted into the slot, and wherein slits are formed on opposite sides of the insertion slot along the longitudinal direction of the insertion hole so that the insertion slot is transformable elastically in the direction of width of the insertion hole by presence of the slits.

DETAILED DESCRIPTION OF PREFERRED EMBODIMENTS

Figure 1:
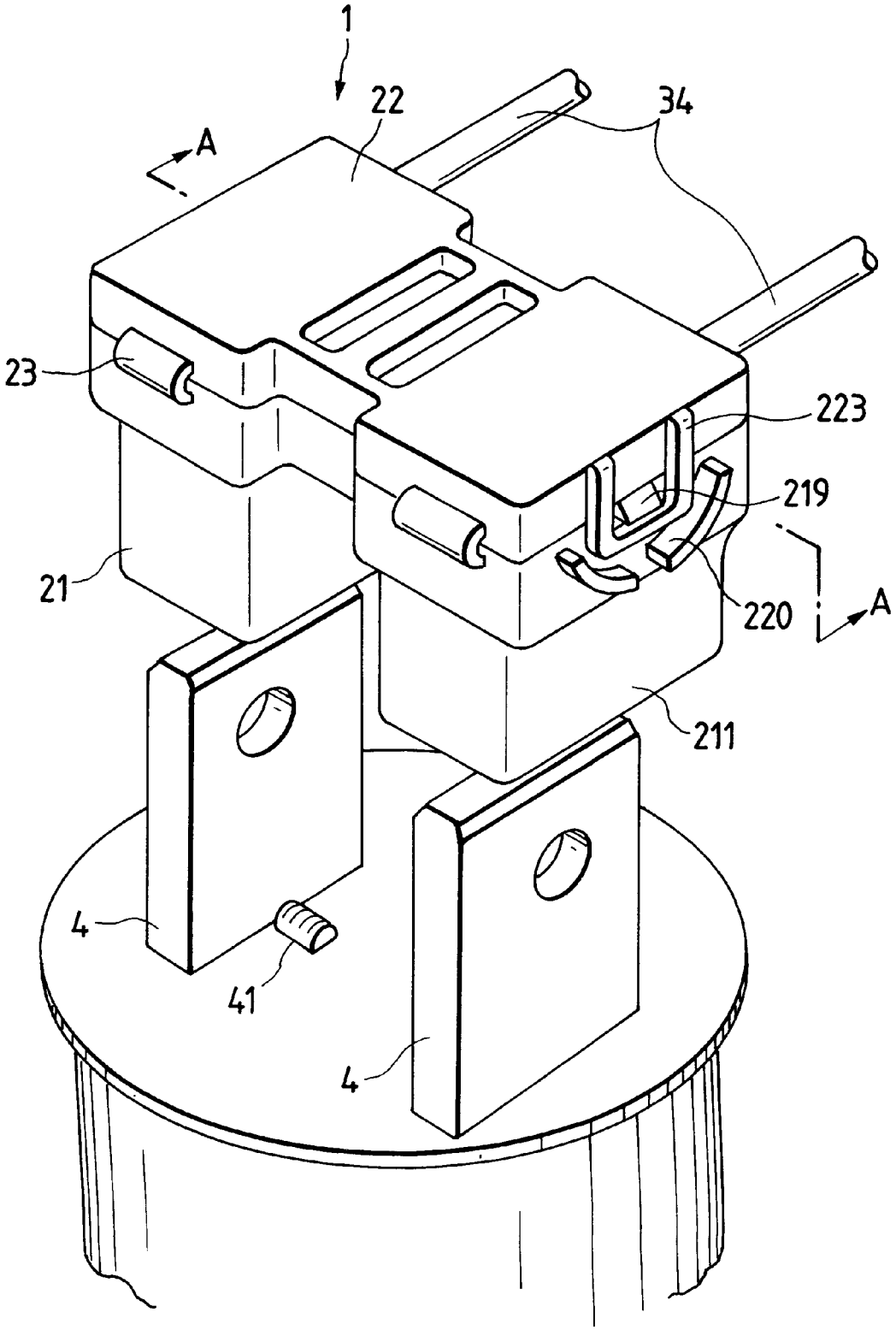
FIG. 1 is an external appearance perspective view of an electric connector of an embodiment according to the present invention.
Figure 2:
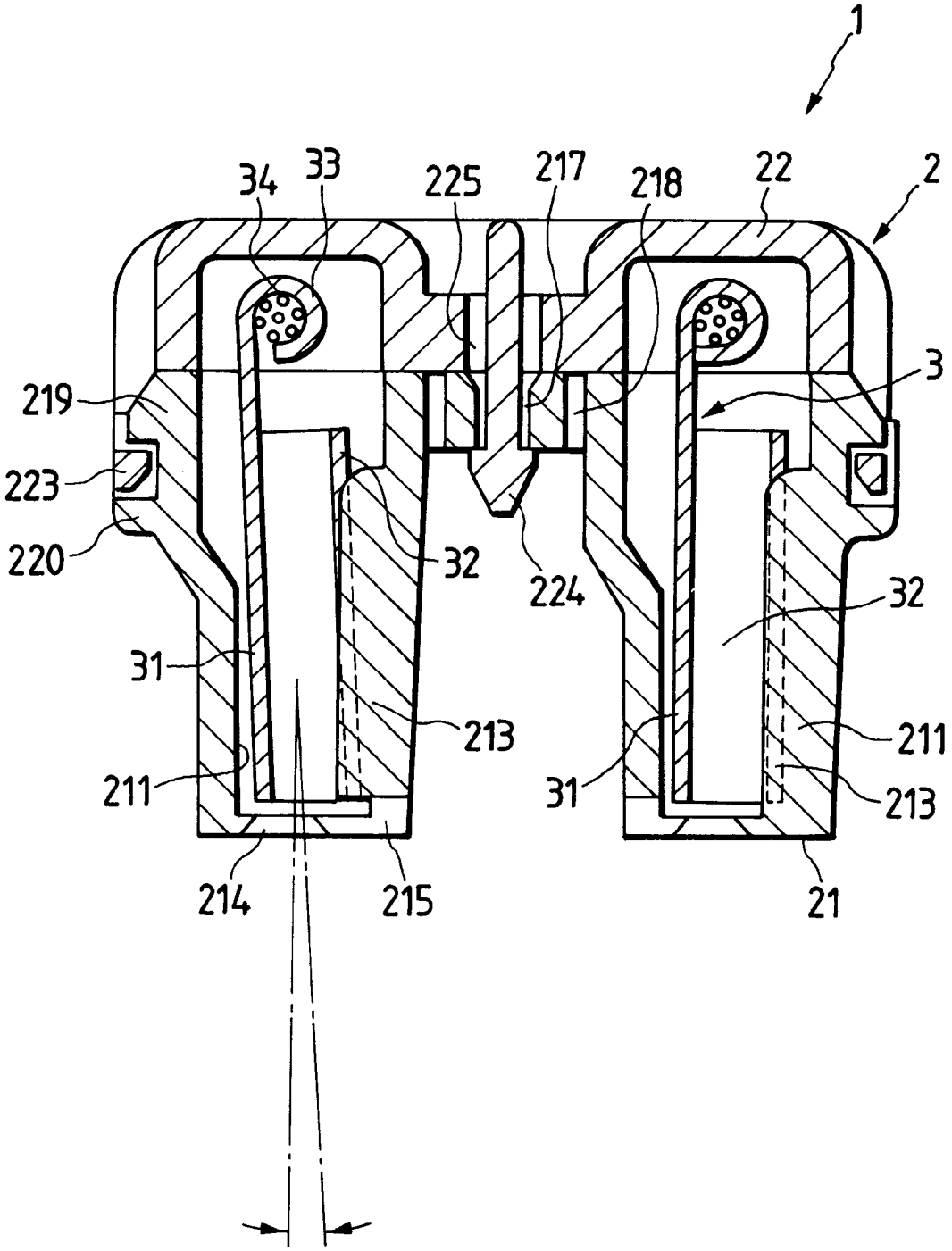
FIG. 2 is a sectional view taken on line A—A of FIG. 1.
Figure 3:
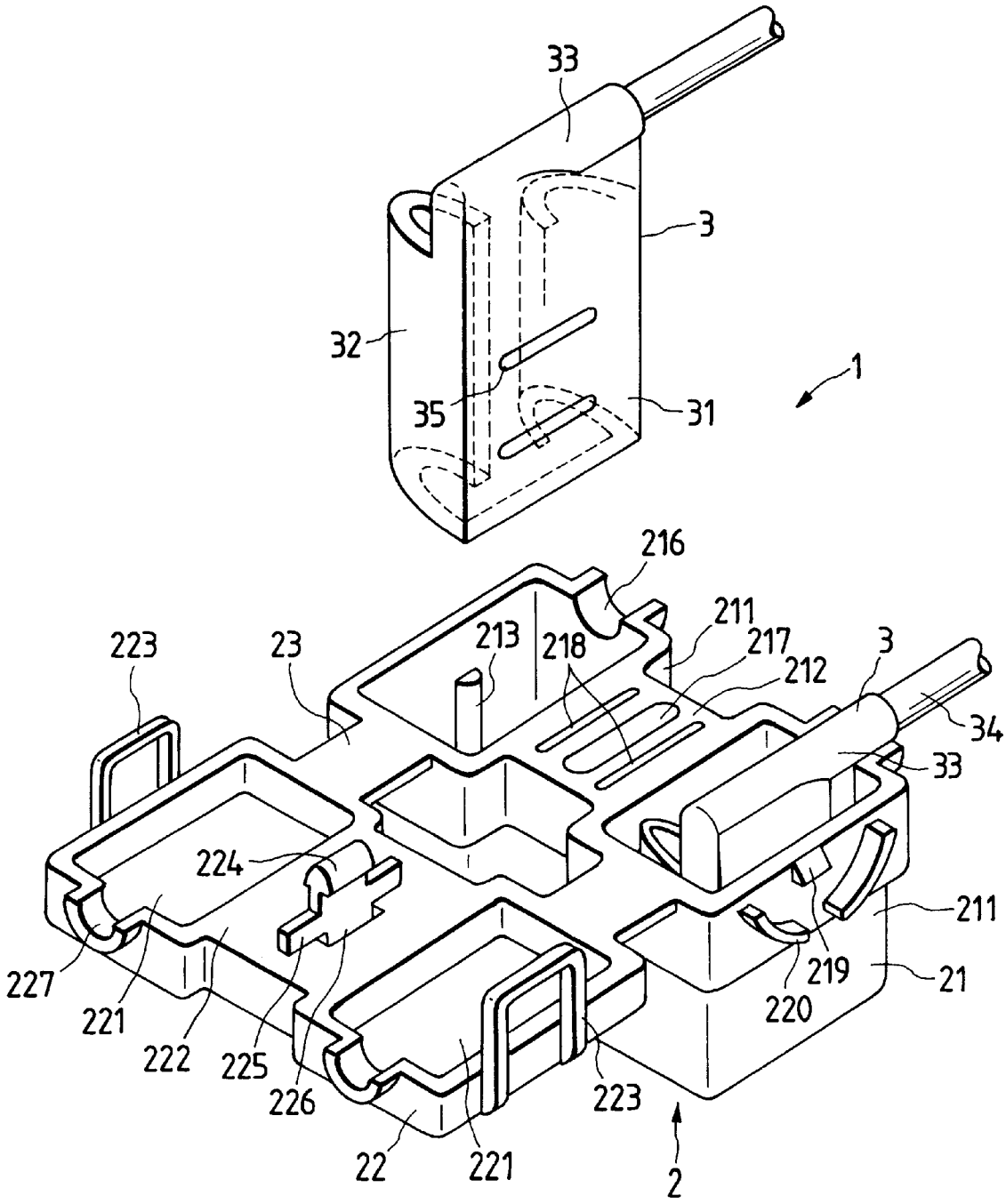
FIG. 3 is a partially exploded perspective view of the state in which the electric connector of FIG. 1 is not assembled yet.

Next, the mode for carrying out the present invention will be described with reference to the drawings. FIG. 1 is an external appearance view of an electric connector according to the present invention, FIG. 2 is a sectional view taken on line A—A of FIG. 1, and FIG. 3 is a partially exploded perspective view of the electric connector in the state before assembling. This electric connector 1 comprises a connector housing 2 molded with insulating resin, and two electric terminals 3 inserted into this connector housing 2 fixedly supported therein, similarly to the above-mentioned conventional configuration. In each of the electric terminals 3, each of opposite side portions 32 of a conductive metal member 31 is formed into a J-shape by being bent toward the inner surface as mentioned above. A tongue-like bulb base terminal 4 of a lamp partially shown in FIG. 1 is fitted to the J-shaped side portion 32 so as to realize electric connection. In addition, an end portion of a coated wire 34 is fixedly caulked at one end portion 33 of each of the conductive metal members 31, similarly to the conventional case. A plurality of slits 35 are provided in parallel in the surface of each of the electric terminal 3 so as to generate an elastic force to improve the electric connection performance when the bulb base terminal 4 is inserted.

Figure 4:
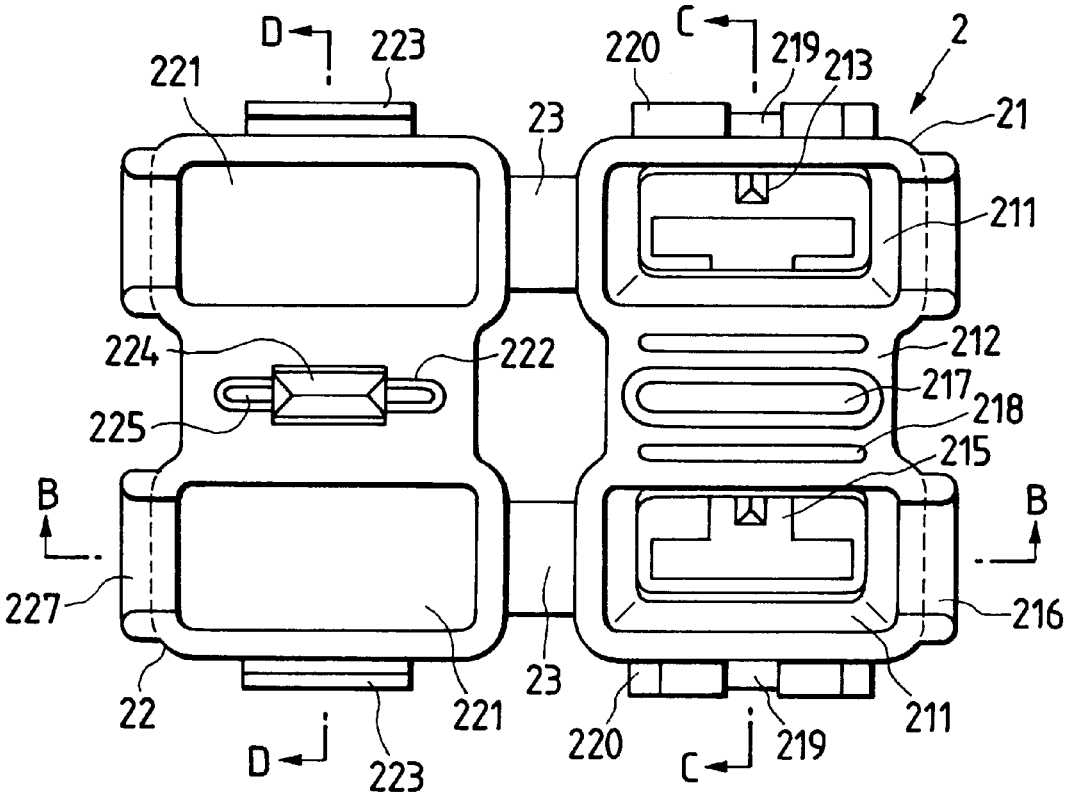
FIG. 4 is a plan view of the connector house in the state before it is assembled.
Figure 5A:
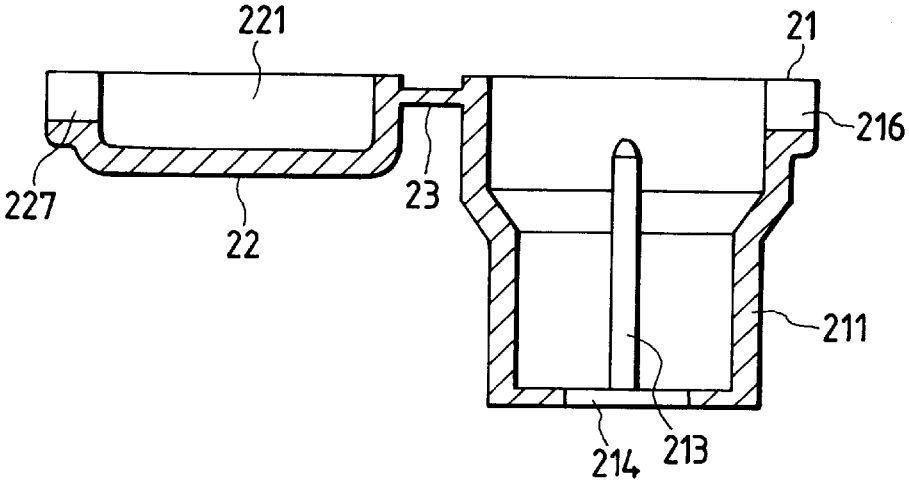
FIGS. 5(*a*) to 5(*c*) are sectional views taken on line B—B, line C—C and line D—D in FIG. 4.
Figure 5B:
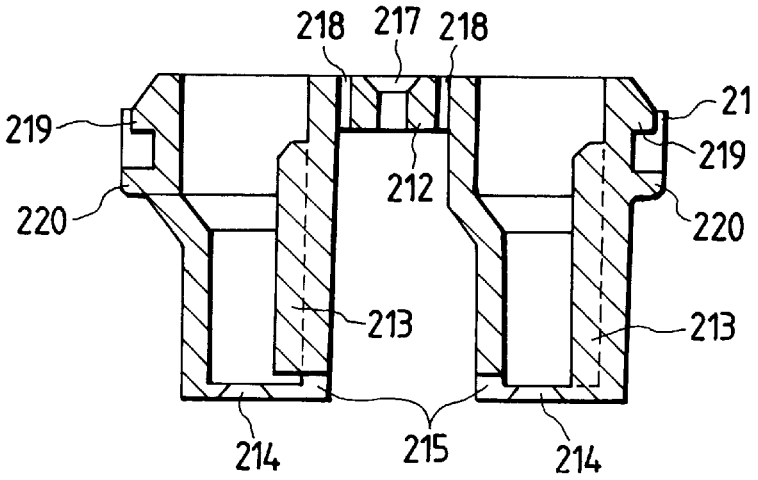
Figure 5C:
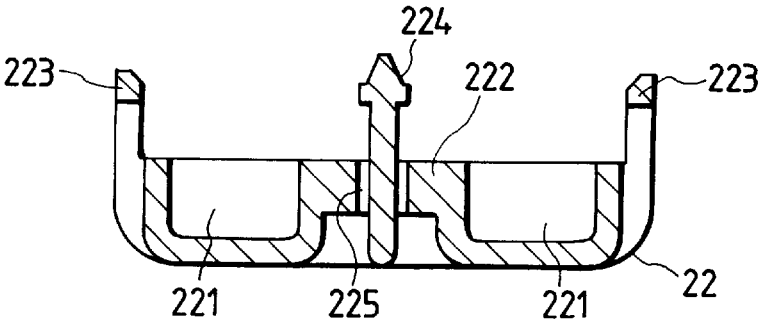
Figure 6:
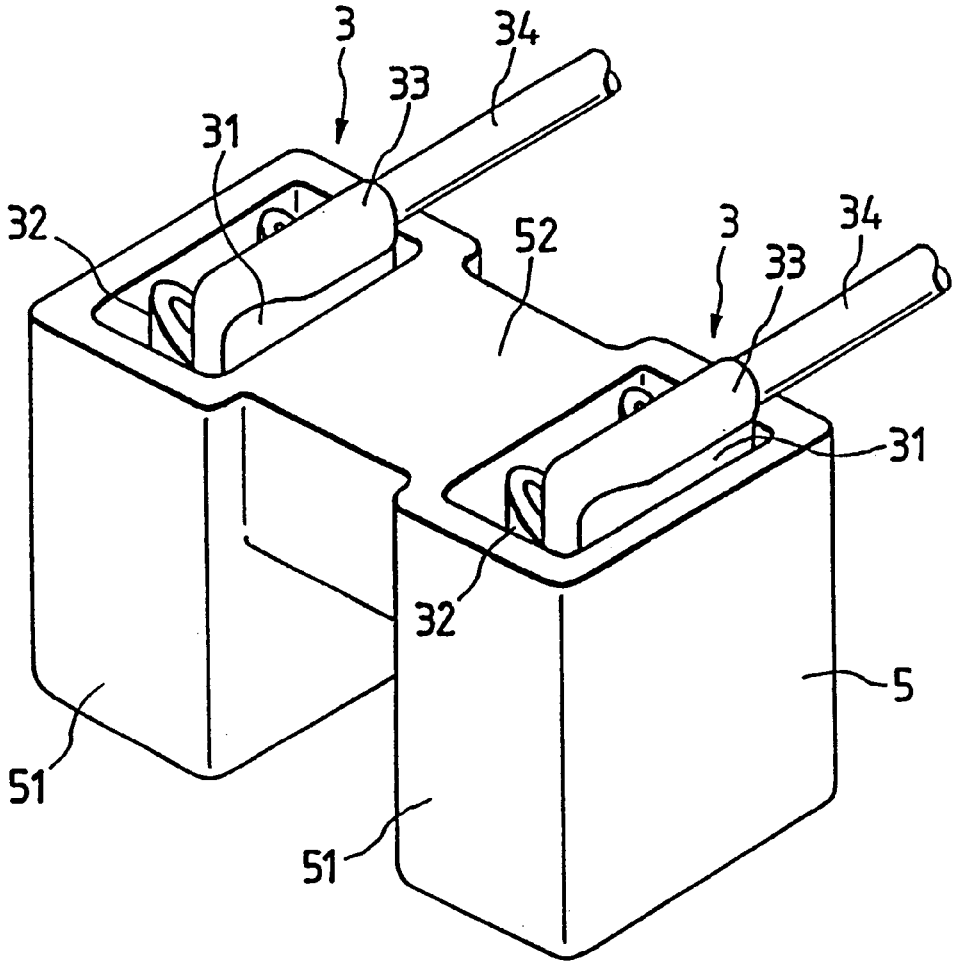
PRIOR ART FIG. 6
FIG. 6 is a perspective view illustrating an example of a conventional electric connector.

On the other hand, the connector housing 2 comprises a body portion 21 and a cover portion 22, as shown in plan in FIG. 4, and as shown in section in FIGS. 5(*a*), 5(*b*) and 5(*c*) respectively taken on line B—B, line C—C and line D—D in FIG. 4. The body portion 21 and the cover portion 22 are integrated with each other through hinge portions 23. The connector housing 2 comprising the body portion 21 and cover portion 22 is formed as a piece by molding, for instance. In the body portion 21, two rectangular pipe-like portions 211 are arranged in parallel at a predetermined distance, and the base portions of the rectangular pipe-like portions 211 are integrated through a connection portion 212 formed between the rectangular pipe-like portions 211. Each of the rectangular pipe-like portions 211 is formed to have a little larger inner-size than the metal member 31 so that the electric terminal 3 can be inserted therein. In addition, a rib 213 is formed to extend in the axial direction of the rectangular pipe-like portion and project substantially at the center of one inner side of each of the rectangular pipe-like portions 211 so as to restrict the direction of insertion of the electric terminal 3, as will be described later. In addition, the size of an opening portion 214 provided in a top end portion of each of the rectangular pipe-like portions 211 is made smaller than the outer size of the electric terminal 3 so as to prevent the electric terminal 3 from coming off from the top end opening portion 214. A relief notch 215 for making room for a spot-welded portion 41 produced at a base portion of the bulb base terminal 4 is provided at this top end opening portion 214.

In addition, a semi-circular supporting portion 216 for supporting a coated wire 34 fixedly clamped with the electric terminal 3 is provided at a base portion of each of the two rectangular pipe-like portions 211, so that the coated wire 34 is held between the supporting portion 216 and a semi-circular holding portion 227 provided in the cover portion 22 correspondingly to the supporting portion 216. In addition, the connection portion 212 connecting the two rectangular pipe-like portions 211 has an insertion slot 217 which is formed so as to penetrate the connection portion 212 in its thickness direction so that an inside lance 224 provided on the cover portion 22, which will be described later, is inserted into the insertion slot. In addition, slits 218 are formed in parallel on the opposite sides of this insertion slot 217. These slits 218 allow the insertion slot 217 to expand its width between its opposite side portions thereof to some extent. Further, outside lances 219 are outward formed on opposite outer surfaces of the rectangular pipe-like portions 211 respectively, and detachment preventing walls 220 are formed in the positions surrounding these lances 219 respectively so as to provide a function to lock the cover portion 22, as will be described later.

In addition, the hinge portions 23 are formed so as to be thin enough to provide flexibility. When this hinge portions 23 are bent, the cover portion 22 covers the base portion of the body portion 21 so that the base portions of the respective rectangular pipe-like portions 211 is closed. This cover portion 22 has a pair of shallow cover bodies 221 which made opposite to the respective rectangular pipe-like portions 211 of the body portion 21. These cover bodies 221 are formed integrally through a connection member 222. At the same time, gate-like lock members 223 are formed so as to project from the opposite side portions of the cover portion 22. Further, a thin inside lance 224 is formed so as to project upward from the center portion of the cover portion 22. When the cover portion 22 is bent at the hinge portion 23 so as to cover the body portion 21, the lock members 223 engage with the outside lances 219 provided on the opposite side surfaces of the body portion 21. At the same time, the inside lance 224 of the cover portion 22 is fitted into the insertion slot 217. The cover portion 22 is locked in the body portion 21 through fitting and engagement by means of these lances 224 and 219, so that the opening portions at the base portions of the respective rectangular pipe-like portions 211 are closed by the respective cover bodies 221. In addition, in this closed state, restriction portions 225 longitudinally extended at the base portion of the inside lance 224 are inserted into the insertion slot 217 so as to prevent the cover portion 22 from displacing longitudinally. Openings 226 are provided on opposite sides of this restriction portions 225 so as to function as mold removing holes when the inside lance 224 is molded with resin. Further, semi-circular cylindrical holding portions 227 are provided in the cover portion 22 so as to be opposite to the respective supporting portions 216 of the body portion 21. A coated wire is held by each pair of the holding portion 227 and the supporting portion 216 of the body portion 21.

According to this configuration, the above-mentioned electric terminals 3 available on the market are inserted into the respective rectangular pipe-like portions 211 of the body portion 21 of the connector housing 1 respectively. Next, the hinge portions 23 are bent to bring the cover portion 22 into contact with the base portion of the body portion 21, so that the rectangular pipe-like portions 211 are closed and integrated with the respective cover bodies 221. The electric connector 1 shown in FIG. 1 is configured in such a manner. In this configuration, if the direction of insertion of the metal member 31 of the electric terminal 3 is reversed with respect to the rectangular pipe-like portion 211 when the electric terminal 3 is inserted, that is, if the electric terminal 3 is inserted with the inner and outer surfaces of the metal member 31 arranged reversely, the rib 213 provided on one inner surface of the rectangular pipe-like portion 211 collides with the metal member 31 so that the insertion of the electric terminal 3 is prevented. Therefore, the metal member 31 can be inserted so that its inner and outer surfaces are disposed properly. When the hinge portions 23 are bent so that the cover portion 22 is pushed onto the body portion 21 strongly after the electric terminals 3 are inserted, the insertion slot 217 receives the inside lance 224 while the opposite side portions of the insertion slot 217 are elastically transformed outward by the presence of the slits 218 to thereby complete the fitting of the inside lance 224. On the other hand, the engagement members 223 are elastically transformed outward so as to get over the outside lances 219 to thereby complete the engagement of the engagement members 223 so that the cover portion 22 is closed and locked by the fitting of the inside lance 224 and engagement of the outside lances 219. Then, because the detachment preventing walls 220 are provided so as to extend along the outer edges of the engagement members 223 which are exposed outside, these detachment preventing walls 220 prevent the lock state of the engagement members 223 and the outside lances 219 from being released by an external force which interferes with the lock members.

On the other hand, the electric terminals 3 mounted into the respective rectangular pipe-like portions 211 are held in a condition that they are received in the rectangular pipe-like portions 211, because the size of the opening portion 214 of each top end portion of the rectangular pipe-like portions 211 is smaller than the size of the metal member 31 of each of the electric terminals 3, and the base portion is covered with the cover body 211. In addition, the inner size of each of the rectangular pipe-like portions 211 is formed so as to be a little larger than the metal member 31. Therefore, the metal member 31 can slightly move thickwise and widthwise when the metal member 31 is held in the rectangular pipe-like portion 211. As a result, even if there is a size error in the connector housing 2 or the bulb base terminal 3 when the electric connector 1 is fitted to the bulb base terminals 4, this size error can be absorbed, for example, by the acceptable angle of the metal member 31 as indicated by the chain line in FIG. 2. Accordingly, the respective electric terminals 3 are fitted to the bulb base terminals 4 suitably so that electric connection is performed securely.

Therefore, in this electric connector 1, no bonding agent and no special electric terminals are required to fix the electric terminals 3 into the connector housing 2. Accordingly, not only it is possible to perform the manufacture and assembly of the electric connector easily, but also it is possible to reduce the cost. Particularly, after the electric terminals 3 are once inserted into the connector housing 2, the electric terminals 3 can be taken out by releasing the engagement of the cover portion 22. Accordingly, it is possible to perform the exchange or inspection of the electric connector easily. In addition, the electric terminals 3 inserted in the body portion 21 of the connector housing 2 are covered with the cover portion 22 entirely. Accordingly, there is no fear that the electric terminals 3 are exposed to cause shortcircuit or cause an accident of touching by a human hand. Therefore, the electric connector 1 is superior in safety. Further, the body portion 21 and the cover portion 22 engage with each other at three places in total, that is, at the inside lance 224 at the center of the connector housing 2 and the outside lances 210 on the opposite sides of the connector housing 2. Accordingly, there is no fear that the cover portion 22 is detached from the body portion 21 easily even if there arises a pinch or the like in the coated wire 34. In addition, the cover portion 22 is prevented from being detached even if the hinge portions 23 are broken. It is therefore possible to prevent the electric terminals 3 from being exposed more surely.

Although the above mode for carrying out the present invention is described about the case where an electric connector for connecting wires to bulb base terminals of a lamp is used, the present invention is also applicable to electric connectors used for other usages in the same manner as described above. In addition, the present invention is also applicable to electric connectors having three or more electric terminals.

According to the present invention, a connector housing is constituted by a pipe-like body portion into which electric terminals are inserted from the base-end opening portions of the body portion, a cover portion for covering the base-end opening portions of this body portion, and hinge portions connecting the body portion to the cover portion and capable of being bent to make cover portion to cover the body portion. Accordingly, the inserted electric terminals can be covered with the cover portion to thereby prevent the electric terminals from coming off. Further, the attachment or detachment of the electric terminals can be carried out easily. In addition, short-circuit or an accident of electric shock caused by exposure of the electric terminals can be prevented so that safety can be improved. In addition, ordinary electric terminals can be used as they are so that it is not necessary to prepare special electric terminals. In addition, the structure of the connector housing is not complicated so that reduction of cost can be advantageously expected.

What is claimed is:

1. An electric connector, comprising:

electric terminals; and a connector housing formed from an insulating member, wherein said connector housing comprises, a body portion having a pipe-like shape with base-end opening portions to which said electric terminals are inserted, respectively, and top-end opening portions opposite said base-end opening portions for receiving additional electric terminals to connect with said electric terminals, a cover portion for covering said base-end opening portions of said body portion, a hinge portion connecting said body portion with said cover portion and being deformable to bend to make said cover portion cover said body portion, and means for locking said body portion and said cover portion with each other provided on at least one of said body portion and said cover portion, so as to maintain a state of covering said body portion with said cover portion; and wherein said lock means are provided at opposite side portions and center portion on each of said body portion and said cover portion, and, wherein said lock means provided at said center portions comprises:

a lock lance provided at either one of said body portion and said cover portion; and an insertion slot at the other of said body portion and said cover portion to receive said lock lance, wherein slits are formed on opposite sides of said insertion slot along the longitudinal direction of said insertion slot to enable said insertion slot to elastically deform in the direction of said slits during an insertion of said lock lance in said slot.

2. The electric connector according to claim 1, wherein said top-end opening portions are smaller than said base-end opening portions so as to restrict said electrical terminals from passing through said top-end opening portions.

3. The electric connector according to claim 1, wherein rib portions are formed on a side of sets of inner walls of the body portion and said rib portions are extended in a direction from the top-end opening portions to the base-end opening portions so as to guide the electric terminals properly.

4. An electric connector housing for electric terminals, comprising:

a body portion having a pipe-like shape with base-end opening portions to which the electric terminals are inserted, respectively, and top-end opening portions opposite said base-end opening portions for receiving additional electric terminals to connect with the electric terminals;

a cover portion for covering said base-end opening portions of said body portion;

a hinge portion connecting said body portion with said cover portion and being deformable to bend to make said cover portion cover said body portion;

means for locking said body portion and said cover portion with each other provided on at least one of said body portion and said cover portion, so as to maintain a state of covering said body portion with said cover portion, wherein said lock means are provided at opposite side portions and center portion on each of said body portion and said cover portion; and wherein said lock means provided at said center portions comprises:

a lock lance provided at either of said body portion and said cover portion; and an insertion slot at the other of said body portion and said cover portion to receive said lock lance, wherein slits are formed on opposite sides of said insertion slot along the longitudinal direction of said insertion slot to enable said insertion slot to elastically deform in the direction of said slits during an insertion of said lock lance in said slot.

5. The electric connector housing according to claim 4, wherein said top-end opening portions are smaller than said base-end opening portions so as to restrict the electrical terminals from passing through said top-end opening portions.

* * * * *